US005507971A

United States Patent [19]

Ouzounis et al.

[11] Patent Number: 5,507,971

[45] Date of Patent: Apr. 16, 1996

[54] LIQUID CLEANERS FOR HARD SURFACES

[75] Inventors: Dimitrios Ouzounis, Krefeld; Ulrich Eicken, Korschenbroich; Eva Kiewert; Herbert Fischer, both of Duesseldorf, all of Germany

[73] Assignee: Henkel Kommanditgesellschaft auf Aktien, Duesseldorf, Germany

[21] Appl. No.: 307,812

[22] PCT Filed: Mar. 18, 1993

[86] PCT No.: PCT/EP93/00658

§ 371 Date: Sep. 27, 1994

§ 102(e) Date: Sep. 27, 1994

[87] PCT Pub. No.: WO93/20173

PCT Pub. Date: Oct. 14, 1993

[30] Foreign Application Priority Data

Mar. 27, 1992 [DE] Germany ..... 42 09 023.4

[51] Int. Cl.[6] ..... C11D 3/37

[52] U.S. Cl. ..... 252/174.24; 252/174.23; 252/DIG. 2

[58] Field of Search ..... 252/174.23, 174.24, 252/DIG. 2

[56] References Cited

U.S. PATENT DOCUMENTS

| | | | |
|---|---|---|---|
| 2,754,280 | 7/1956 | Brown et al. | 260/29.6 |
| 2,795,564 | 6/1957 | Conn et al. | 260/29.6 |
| 4,122,025 | 10/1978 | Kiewert et al. | 252/173 |
| 4,661,170 | 4/1987 | Osberghaus | 148/6.27 |
| 4,685,931 | 8/1987 | Schieferstein et al. | 8/406 |
| 4,725,319 | 2/1988 | Osberghaus | 134/4 |
| 4,795,772 | 6/1989 | Hsieh | 524/159 |

FOREIGN PATENT DOCUMENTS

| | | |
|---|---|---|
| 0278216 | 1/1970 | Austria . |
| 0009193 | 4/1980 | European Pat. Off. . |
| 0014035 | 8/1980 | European Pat. Off. . |
| 0066342 | 12/1982 | European Pat. Off. . |
| 0089213 | 9/1983 | European Pat. Off. . |
| 0184785 | 6/1986 | European Pat. Off. . |
| 0215451 | 3/1987 | European Pat. Off. . |
| 0245987 | 11/1987 | European Pat. Off. . |
| 1924332 | 11/1970 | Germany . |
| 2220540 | 11/1973 | Germany . |
| 2840463 | 3/1980 | Germany . |
| 2840464 | 4/1980 | Germany . |
| 2913049 | 10/1980 | Germany . |
| 3024727 | 1/1982 | Germany . |
| 3129262 | 2/1983 | Germany . |
| 3130992 | 2/1983 | Germany . |
| 3720262 | 12/1983 | Germany . |
| 3434668 | 4/1986 | Germany . |
| 3813651 | 11/1989 | Germany . |
| 1073947 | 6/1967 | United Kingdom . |
| 2104091 | 3/1983 | United Kingdom . |

OTHER PUBLICATIONS

Chemical Abstracts, vol. 97, No. 8, Aug. 1982, Columbus, Ohio, US, Ab JP 8244700.

*Primary Examiner*—Margaret Einsmann
*Attorney, Agent, or Firm*—Ernest G. Szoke; Wayne C. Jaeschke; Real J. Grandmaison

[57] ABSTRACT

A composition and process for cleaning hard surfaces, the composition containing from 0.001 to 2% by weight, based on the weight of the composition, of a detergency booster comprising a copolymer of (a) from 20 to 80% by weight of esters selected from the group consisting of acrylic acid and methacrylic acid containing 1 to 4 carbon atoms in the alcohol component, and (b) from 20 to 80% by weight of acrylic acid or methacrylic acid, wherein the copolymer has an intrinsic viscosity of at least 200 $ml.g^{-1}$ as measured in tetrahydrofuran at 20° C.

12 Claims, No Drawings

LIQUID CLEANERS FOR HARD SURFACES

BACKGROUND OF THE INVENTION

1. Field of the Invention

Modern production methods, easy-care kitchen, bathroom and cellar fittings, plastic-veneered furniture, the equipping of households to an increasing extent with freezers, refrigerators, washing machines and dishwashers, i.e. appliances with enamelled or plastic-coated metal walls of large surface area, ensure a continuing demand for liquid multipurpose cleaners for use in the home. In industry also, the importance of using liquid multipurpose cleaners shows no sign of diminishing. The main demand is still for easy and problem-free use. The cleaners are generally marketed in the form of preferably water-based concentrates. They may be applied in diluted or undiluted form to a moist absorbent cloth of any quality or to a sponge with which hard surfaces of metal, painted wood, plastic, ceramic products, such as porcelain, tiles and the like, can then be wiped and thus freed from dust, greasy soil and stains. It is desirable that the cleaner used should not leave behind any marks or streaks after this surface treatment and that there should be no need for aftertreatment with a damp cloth soaked with clear water.

2. Discussion of Related Art

Numerous multipurpose liquid cleaners are already known both from the market and from the literature. In addition, it is also known from the patent literature that various polymers can be added to such cleaners to enhance their cleaning performance.

Thus, AT-PS 278 216 describes liquid cleaners which may contain water-soluble high molecular weight substances as soil suspending agents. Water-soluble salts of polyacrylic acid inter alia are mentioned as examples.

German patent applications 28 40 463 and 28 40 464 describe the use of high molecular weight polyethylene glycols while German patent application 29 13 049 describes the use of inter alia polyvinyl alcohols, polyvinyl pyrrolidones and polyacrylamides as detergency boosters.

According to GB-PS 1,073,947, polyacrylamides inter alia improve the soil suspending power of liquid cleaners for hard and poorly accessible surfaces.

German patent application 22 20 540 describes polymers of aromatic monovinyl monomers with unsaturated dicarboxylic acids while European patent application 66 342 describes the same class of compounds, but in partly esterified form, for improving the appearance of the cleaned surfaces and for avoiding the misting of glass by steam.

British patent application 2,104,091 describes liquid cleaners which, in addition to typical anionic, nonionic, cationic or amphoteric surfactants, contain an addition of an amphoteric polymer compound prepared by polymerization of a cationic vinyl monomer with an anionic vinyl monomer. This addition, which is used in smaller quantities by comparison with the surfactant, is said to improve cleaning power.

Finally, DE 37 20 262 describes liquid cleaners for hard surfaces which contain a detergency-boosting mixture of polyacrylamides and highly polyethoxylated monofunctional or polyfunctional alkanols containing 12 to 22 carbon atoms in the molecule.

For the most part, these polymers, some of which have been known for a long time, have not acquired any appreciable significance as additives to domestic cleaners used in large quantities. Some of the disadvantages of these known polymers include, for example, their inadequate solubility in the cleaner, their excessive thickening effect and the formation of residues, i.e. streaks or films, in the practical application of the cleaners when the polymers are present in the quantities required to boost detergency. However, the complicated production of these known polymers and their inadequate stability in storage were also obstacles to their problem-free use in practice.

DESCRIPTION OF THE INVENTION

It has now surprisingly been found that a completely unexpected improvement in the cleaning performance of liquid cleaners for hard surfaces can be obtained by adding much smaller quantities of anionic copolymers of ethyl acrylate, methacrylic acid and/or acrylic acid together with or instead of the known additions of soil-suspending compounds. Since the high molecular weight of such copolymers is occasionally difficult to determine, it is advisable to include their intrinsic viscosity [η], as measured in tetrahydrofuran (THF) at 20° C., in the characterization of the copolymers. The relation $[\eta]=k.M^{\alpha}$, where k and α are constants, exists between the intrinsic viscosity and the molecular weight; if these constants are known for the particular comonomers of the composition, molecular weight can be numerically determined (cf. B. Vollmert, reference in the experimental section).

Accordingly, the present invention relates to a liquid cleaner for hard surfaces based on preferably aqueous solutions containing anionic and/or nonionic surfactants, detergency boosters, optionally organic and/or inorganic builders, water-soluble solvents or solubilizers and other typical constituents of liquid cleaners, characterized in that it contains 0.001 to 2% by weight and preferably 0.005 to 1.0% by weight of copolymers of a) esters of acrylic and/or methacrylic acid containing 1 to 8 carbon atoms in the alcohol component and b) acrylic acid and/or methacrylic acid with an intrinsic viscosity [η] of $\geqq 100$ $ml.g^{-1}$, as measured in THF at 20° C., as detergency boosters. When used in these quantities, which unexpectedly boost detergency, none of the above-mentioned disadvantages of known polymers is observed.

The anionic copolymers mentioned are produced in known manner by emulsion polymerization as described, for example, in U.S. Pat. No. 4,795,772 or EP 184 785. Particularly suitable copolymers are copolymers of a) around 80 to 20 and preferably around 60 to 40% by weight of esters of acrylic acid and/or methacrylic acid containing 1 to 4 and, more particularly, 1 to 2 carbon atoms in the alcohol component and b) around 20 to 80 and preferably around 40 to 60% by weight of acrylic and/or methacrylic acid with an intrinsic viscosity [η] of $\geqq 100$ $ml.g^{-1}$, as measured in THF at 20° C. They are substantially uncrosslinked. Copolymers of 55% by weight of ethyl acrylate, 35% by weight of methacrylic acid and 10% by weight of acrylic acid with an intrinsic viscosity [η] of $\geqq 200$ and, more particularly, $\geqq 400$ $ml.g^{-1}$, as measured in THF at 20° C., are particularly suitable.

The copolymers may also contain small quantities, i.e. up to about 5% by weight, of other radical-polymerizable vinyl monomers such as, for example, styrene, vinyl acetate, acrylamide, methacrylamide or substituted methacrylamides or (meth)acrylates, such as ethylhexyl acrylate. The copolymers are acidic dispersions and are best used in this form. When incorporated in the detergents, which generally have a neutral to mildly alkaline pH value, the copolymers are partly or completely neutralized and dissolved so that they are no longer present in dispersed form.

By virtue of the small quantity of polymers used in accordance with the invention, the ratio by weight of the total quantity of surfactant to the polymer is at least about 10:1 and, more particularly, at least about 20:1.

Copolymers of the monomers also used in accordance with the invention are already described in DE 31 29 262. However, the acid component of these copolymers is considerably smaller and the copolymers are used for the durable surface coating of plastics.

Similar copolymers crosslinked by polyvalent cations have been used as coating compositions and preservatives for metal surfaces (cf. U.S. Pat. No. 2,754,280, U.S. Pat. No. 2,795,564, EP 14 035, DE 30 24 727 and DE 34 34 668). Other similar copolymers are known as thickeners for aqueous liquid phases and as flocculants (DE 38 13 651 and DE 31 30 992). There was nothing in this prior art to suggest that the copolymers used in accordance with the invention would neither thicken nor act as flocculants, but instead would contribute towards boosting detergency.

A further addition of high-polymer polyethylene oxides with $\overline{MW}$ values of ≧600,000 can be of advantage.

Any standard surfactants and mixtures of surfactants which contain at least one hydrophobic organic radical add a water-solubilizing anionic, nonionic or cationic radical in the molecule may be used in quantities of around 0.05 to 40% by weight and preferably in quantities of 5 to 30% by weight. The hydrophobic radical is generally an aliphatic hydrocarbon radical containing 8 to 26, preferably 8 to 22 and more preferably 8 to 18 carbon atoms or an aromatic alkyl radical containing 6 to 18 and preferably 8 to 16 aliphatic carbon atoms. In the case of surfactant mixtures, the well-known incompatibility of most anionic and cationic surfactants with one another should be borne in mind.

Surfactants from the group of anionic surfactants, including soaps, and nonionic surfactants and mixtures thereof are preferably used in quantities of around 5 to 30% by weight. Surfactant combinations of anionic surfactants from the group of sulfonate and sulfate surfactants and nonionic surfactants of the ethoxylated alkanol, alkenol and alkylphenol type are particularly preferred. A soap may be present as an additional component.

Suitable anionic surfactants are, for example, soaps of natural or synthetic, preferably saturated fatty acids and even soaps of resinic or naphthenic acids, Suitable synthetic anionic surfactants are those of the sulfonate, sulfate and synthetic carboxylate type.

Suitable surfactants of the sulfonate type are alkyl benzenesulfonates ($C_{9-15}$ alkyl), mixtures of alkene and hydroxyalkanesulfonates and also the disulfonates obtained, for example, from monoolefins with a terminal or internal double bond by sulfonation with gaseous sulfur trioxide and subsequent alkaline or acidic hydrolysis of the sulfonation group. Other suitable surfactants of the sulfonate type are the alkanesulfonates obtainable from alkanes by sulfochlorination or sulfoxidation and subsequent hydrolysis or neutralization or by addition of bisulfite onto olefins.

Other suitable surfactants of the sulfonate type are the esters of α-sulfofatty acids, for example the α-sulfonated acids of hydrogenated methyl or ethyl esters of coconut oil, palm kernel or tallow fatty acid.

Suitable surfactants of the sulfate type are the sulfuric acid monoesters of primary alcohols (for example coconut oil fatty alcohols, tallow fatty alcohols or oleyl alcohol) and those of secondary alcohols. Sulfated fatty acid alkanolamides, fatty acid monoglycerides or reaction products of 1 to 4 moles of ethylene oxide with primary or secondary fatty alcohols or alkylphenols are also suitable. Other suitable anionic surfactants are the fatty acid esters and amides of hydroxycarboxylic acid or aminocarboxylic acids and sulfonic acids, such as for example fatty acid sarcosides, glycolates, lactates, taurides or isethionates.

The anionic surfactants may be present in the form of their alkali metal, alkaline earth metal and ammonium salts and also as soluble salts of organic bases, such as mono-, di- or triethanolamine. The sodium salts are generally preferred for reasons of cost.

Suitable nonionic surfactants are adducts of 2 to 40 moles and preferably 2 to 20 moles of ethylene oxide or ethylene oxide and propylene oxide with 1 mole of fatty alcohol, alkanediol, alkylphenol, fatty acid, fatty amine, fatty acid amide or alkanesulfonamide. The addition products of 3 to 16 moles of ethylene oxide or ethylene and propylene oxide with coconut oil or tallow fatty alcohols, with oleyl alcohol or with secondary alcohols containing 8 to 18 carbon atoms and with mono- or dialkylphenols containing 6 to 14 carbon atoms in the alkyl radicals are of particular importance. In addition to these water-soluble nonionics, however, water-insoluble or substantially water-insoluble polyglycol ethers containing 1 to 4 ethylene glycol ether groups in the molecule are also of interest, particularly if they are used in conjunction with water-soluble nonionic or anionic surfactants. Alkyl glycosides are also a class of nonionic surfactants suitable for use in accordance with the invention.

Other suitable nonionic surfactants are the water-soluble adducts of ethylene oxide with propylene oxide containing 20 to 250 ethylene glycol ether groups and 10 to 100 propylene glycol ether groups, alkylenediamine polypropylene glycols and alkyl polypropylene glycols with 1 to 10 carbon atoms in the alkyl chain in which the polypropylene glycol chain performs a hydrophobic function. Nonionic surfactants of the amine oxide type may also be used. Typical representatives are, for example, the compounds N-dodecyl-N,N-dimethylamine oxide, N-tetradecyl-N,N-dihydroxyethylamine oxide, N-hexadecyl-N,N-bis-(2,3-dihydroxypropyl)-amine oxide.

Inorganic or organic compounds showing overall an alkaline reaction, more particularly inorganic or organic complexing agents, which are preferably present in the form of their alkali metal or amine salts, more particularly their potassium salts, are used as builders for the liquid cleaners according to the invention in quantities of up to about 10% by weight and preferably in quantities of around 1 to 6% by weight. In the context of the invention, builders also include the alkali metal hydroxides. Suitable inorganic complexing builders are, in particular, the polyphosphates showing an alkaline reaction, more particularly tripolyphosphates and pyrophosphates and orthophosphates. They may be completely or partly replaced by organic complexing agents. Other organic builders which may be used in accordance with the invention are, for example, bicarbonates, carbonates, borates and silicates of the alkali metals.

Organic complexing agents of the aminopolycarboxylic acid include inter alia nitrilotriacetic acid, ethylenediamine tetraacetic acid, N-hydroxyethyl ethylenediamine triacetic acid and polyalkylene polyamine-N-polycarboxylic acids. Examples of di- and polyphosphonic acids are methylene diphosphonic acid, 1-hydroxyethane-1,1-diphosphonic acid, 1,2,3-propane triphosphonic acid, 1,2,3,4-butane tetraphosphonic acid, polyvinyl phosphonic acid, copolymers of vinyl phosphonic acid and acrylic acid, 1,2-ethane-1,2-dicarboxydiphosphonic acid, 1,2-ethane-1,2-dicarboxydihydroxydiphosphonic acid, phosphonosuccinic acid, 1-aminoethane-1,1-diphosphonic acid, aminotri-(methylene phosphonic acid), methylamino- or ethyleneamino-di-(methylene phosphonic acid) and ethylenediaminetetra-(methylene phosphonic acid).

Various, generally N- or P-free carboxylic and polycarboxylic acids have recently been proposed as builders in the literature; the polymers in question are often, but not exclusively, carboxyfunctional polymers. A large number of these carboxylic and polycarboxylic acids are able to complex calcium, including for example gluconic acid, citric acid, tartaric acid, benzene hexacarboxylic acid, tetrahydrofuran tetracarboxylic acid, etc.

Since cleaners for use in the home are generally almost neutral to mildly alkaline, i.e. their aqueous inuse solutions have a pH value of 6 to 11 and preferably 7.0 to 10.5 for concentrations of 2 to 20 and preferably 5 to 15 g/l of water or aqueous solution, acidic or alkaline components may have to be added to regulate the pH value.

Suitable acidic substances are typical inorganic or organic acids or acidic salts such as, for example, hydrochloric acid, sulfuric acid, bisulfates of the alkali metals, amidosulfonic acid, phosphoric acid or other acids of phosphorus, more particularly the anhydrous acids of phosphorus or acidic salts thereof or acidic solid compounds thereof with urea or other lower carboxylic acid amides, partial amides of phosphorus acids or anhydrous phosphoric acid, gluconic acid, citric acid, tartaric acid, lactic acid and the like.

If the content of alkaline builders is not sufficient to regulate the pH value, organic or inorganic compounds showing an alkaline reaction, such as alkanolamines, i.e. mono-, di- or triethanolamine, or ammonia, may also be added.

In addition, it is possible to incorporate solubilizers known per se, including so-called hydrotropes of the lower alkylaryl sulfonate type, for example toluene, xylene or cumene sulfonate, in addition to the water-soluble organic solvents, such as in particular low molecular weight aliphatic alcohols containing 1 to 4 carbon atoms. They may also be present in the form of their sodium and/or potassium and/or alkylamine salts. Other suitable solubilizers are water-soluble organic solvents, more particularly those having boiling points above 75° C., such as for example the ethers of identical or different polyhydric alcohols or the partial ethers of polyhydric alcohols, including for example di- or triethylene glycol polyglycerols and the partial ethers of ethylene glycol, propylene glycol, butylene glycol or glycerol with aliphatic monohydric alcohols containing 1 to 4 carbon atoms in the molecule.

Suitable water-soluble or water-emulsifiable organic solvents include ketones, such as acetone, methylethyl ketone, and aliphatic, cycloaliphatic and aromatic hydrocarbons and also the terpene alcohols.

To regulate viscosity, it may be advisable to add higher polyglycol ethers with molecular weights of up to about 600 or polyglycerol. In addition, it may be advisable to add sodium chloride and/or urea to regulate viscosity.

The cleaners according to the invention may also contain additions of dyes and fragrances, preservatives and, if desired, even antimicrobial agents of any kind.

Suitable antimicrobial agents are compounds which are stable and effective in the liquid cleaners according to the invention.

Useful antimicrobial agents are the lower alcohols or diols containing 3 to 5 carbon atoms which are substituted both by bromine and by the nitro group, such as for example the compounds 2-bromo-2-nitropropane-1,3-diol, 1-bromo-1-nitro-3,3,3-trichloropropanol, 2,2-bromo-2-nitro-1-butanol.

In addition, bis-diguanides such as, for example, 1,6-bis-(p-chlorophenyldiguanido)-hexane in the form of the hydrochloride, acetate or gluconate and also N,N'-disubstituted 2-thionetetrahydro-1,3,5-thiadiazines, such as for example 3,5-dimethyl-, 3,5-diallyl-, 3-benzyl-5-methyl- and, in particular, 3-benzyl-5-carboxymethyl tetrahydro-1,3,5-thiadiazine, are also suitable as additional antimicrobial agents.

Formaldehyde/aminoalcohol condensates may also be used. They are obtained by reaction of an aqueous solution of formaldehyde with aminoalcohols, for example 2-aminoethanol, 1-amino-2-propanol, 2-aminoisobutanol, 2-(2'-aminoethyl)-aminoethanol.

In addition, it can be of advantage for other applications to add other antimicrobially active substances, for example of the quaternary ammonium compound type, for example a benzyl alkyl dimethylammonium chloride.

TESTS

To demonstrate their advantages, the cleaners according to the invention were compared with known cleaners for hard surfaces in regard to their cleaning power.

Cleaning power was tested by the method described in "Seifen-Öle-Fette-Wachse" 122, 371, (1986) which gives highly reproducible results. In this test, the cleaner to be tested is applied to an artificially soiled plastic surface. A mixture of carbon black, machine oil, a triglyceride of saturated fatty acids and a relatively low-boiling aliphatic hydrocarbon was used as artificial soil for the dilute application of the cleaner. A mixture of Vaseline®, fatty acid glycerol esters and pigments was used as the test soil for the concentrated use of the cleaner. The test surface measuring 26×28 cm was uniformly coated with 2 g of the artificial soil using a surface spreader.

A plastic sponge was soaked with 10 ml of a 0.1% by weight cleaning solution to be tested and moved mechanically over the test surface which had also been coated with 10 ml of the cleaning solution to be tested. With 10% by weight cleaning solutions, only the test surface was coated with 10 ml of the cleaning solution. After ten wiping movements, the cleaned test surface was held under running water to remove the loose soil. The cleaning effect, i.e. the whiteness of the plastic surface thus cleaned, was measured with a Dr. B. Lange "Microcolor" color difference meter. The clean white plastic surface was used as the white standard.

Since, in the measurement of the clean surface, the instrument was adjusted to 100% and the soiled surface produced a reading of 0, the values read off could be equated with the percentage cleaning power (% CP) for the cleaned plastic surfaces. In the following tests, the percentage CP values shown are the values determined by this method for the cleaning power of the cleaners tested. They represent averages of three measurements.

The measurements were correlated with the cleaning result of a surfactant solution used as standard:

$$\frac{\text{Measured values of sample} \cdot 100}{\text{Measured value of standard}} = \%\ CP\ \text{relative}$$

A solution of 8% of $C_{12/14}$ fatty alcohol reacted with 6 moles of ethylene oxide (EO), 2% of $C_{12/14}$ fatty alcohol ether sulfate.2 EO, 2% of Na gluconate, 0.5% of $NaHCO_3$, 2% of cumenesulfonate, rest distilled water, was used as standard. Accordingly, 0.1% by weight of AS surfactant was used for dilute application and 10% by weight of AS surfactant for concentrated application. It was found that the cleaning performance of surfactant-containing cleaning formulations can be significantly increased by the addition of small amounts of the compounds according to the invention.

Determination of intrinsic viscosity:

The intrinsic viscosity is determined by the method described in B. Vollmert: "Grundriβ der makromolekularen Chemie", Vol. III, pages 55 et seq., E. Vollmert Verlag, Karlsruhe, 1988. In the case of copolymers containing ionic groups, specific viscosity increases proportionally to concentration at high concentrations whereas, at low concentrations, viscosity can decrease with increasing concentration. With the aid of graphs in which concentration is plotted on the abscissa and specific viscosity is plotted on the ordinate, the intrinsic viscosities of these copolymers can be determined by extrapolation of the part which increases linearly at high concentrations to a concentration of 0.

EXAMPLES

Preparation of some of the copolymers used in accordance with the invention:

Example A 55 g of ethyl acrylate, 35 g of methacrylic acid, 10 g of acrylic acid, 8.3 g of $C_{14}$ fatty alcohol.10 EO sulfonate, Na salt, 30% in $H_2O$, 8.3 g of nonylphenol.9.5 EO sulfosuccinate, Na salt, 30% in $H_2O$, 0.1 g of t-butyl hydroperoxide and 378 g of distilled water were introduced into a 1-liter three-necked flask equipped with a stirrer, reflux condenser, internal thermometer, nitrogen inlet and dropping funnel. The mixture was freed from oxygen while stirring by evacuation and purging with nitrogen. The mixture was heated to 25° C. 130 mg of Na formaldehyde sulfoxylate dissolved in 1 ml of $H_2O$ were added through the dropping funnel at the temperature of 25° C. The polymerization reaction began spontaneously, the temperature rising to 55° C. A coagulate-free, fine-particle emulsion with a polymer content of 20% by weight was obtained. The copolymer had an intrinsic viscosity [η] of 455 $ml.g^{-1}$, as measured in THF at 20° C.

Example B

Procedure as for Example A, except that 8.3 g of a $C_{10}$ fatty alcohol.6 EO sulfosuccinate was used instead of the nonylphenol sulfosuccinate. Intrinsic viscosity [η] in THF at 20° C.: 525 $ml.g^{-1}$.

Example C

Procedure as for Example A, except that 55 g of ethyl methacrylate were used instead of ethyl acrylate. Intrinsic viscosity [η] in THF at 20° C.: 460 $ml.g^{-1}$.

Example D

Procedure as for Example A, except that 60 g of ethyl acrylate and 40 g of methacrylic acid were used as monomers. Intrinsic viscosity [η] in THF at 20° C.: 235 $ml.g^{-1}$.

Using the copolymers according to the invention mentioned above as detergency boosters, starting domestic cleaner formulations, which are also suitable for application as spray cleaners, were tested both in diluted form and in concentrated form.

The pH value of the formulations was adjusted to 7.0 as required either with sodium hydroxide or with citric acid.

EXAMPLE 1

Formulations:

| Formulation No. | 1 | 2 | 3 | 4 | 5 | 6 |
|---|---|---|---|---|---|---|
| ABS | 8% | 8% | 8% | — | — | — |
| Nonionic surfactant 1 | 2% | 2% | 2% | — | — | — |
| FAS | — | — | — | 4% | 4% | 4% |
| FAEOS | — | — | — | 6% | 6% | 6% |
| Copolymer of Ex. A | — | 0.1% | 0.2% | — | 0.1% | 0.2% |
| Na gluconate | 2% | | | → | | |
| $NaHCO_3$ | 0.5% | | | → | | |
| Dist. water | Remainder | | | → | | |
| Rel. CP (dilute) % | 152 | 173 | 173 | 123 | 130 | 139 |
| Rel. CP (conc.) % | 148 | 184 | 220 | 56 | 140 | 140 |

The quantities shown are percentages by weight of the pure active substance.
The abbreviations used in the Table have the following meanings:
ABS: $C_{10/13}$ alkyl benzenesulfonate, Na salt
Nonionic surfactant: reaction product of $C_{12/14}$ alkyl epoxide + ethylene glycol + 10 moles EO
FAS: $C_{12/14}$ fatty alcohol sulfate, Na salt
FAEOS: $C_{12/14}$ fatty alcohol ether sulfate with approximately 2 EO, Na salt
Rel. CP (dilute): cleaning power for dilute application
Rel. CP (conc.): cleaning power for concentrated application The results show that the cleaning performance can be boosted by addition of small quantities of the copolymer according to the invention.

EXAMPLE 2

Formulations:

| Formulation No. | 7 | 8 | 9 | 10 | 11 | 12 |
|---|---|---|---|---|---|---|
| FAS | 4% | 4% | 4% | — | — | — |
| FAEOS | 6% | 6% | 6% | — | — | — |
| ABS | — | — | — | 8% | 8% | 8% |
| Nonionic surfactant 1 | — | — | — | 2% | 2% | 2% |
| Na gluconate | 2% | | | → | | |
| $NaHCO_3$ | 0.5% | | | → | | |
| Copolymer of Ex. B | — | 0.1% | 0.2% | — | 0.1% | 0.2% |
| Dist. water | Remainder | | | → | | |
| Rel. CP (dilute) % | 123 | 130 | 134 | 152 | 193 | 198 |
| Rel. CP (conc.) % | 56 | 144 | 148 | 148 | 200 | 204 |

The quantities shown represent percentages by weight of the pure active substance.

The abbreviations used in the Table are explained in Example 1.

Formulations 7 to 12 in conjunction with formulations 1 to 6 show that the detergency-boosting effect of the polyacrylate is not affected by the choice of emulsifier.

EXAMPLE 3

Formulations:

| Formulation No. | 13 | 14 |
|---|---|---|
| Alkanesulfonate | 4% | 4% |
| Nonionic surfactant 2 | 2% | 2% |
| Comp. of Example B | — | 0.1% |
| Dist. water | Remainder | → |
| Rel. CP (dilute)*) % | 107 | 116 |
| Rel. CP (conc.)*) % | 36 | 108 |

The quantities shown represent percentages by weight of the pure active substance.
*In these Examples, a 0.06% by weight surfactant mixture was used for the dilute application and a 6% by weight surfactant mixture for the concentrated application.
Alkanesulfonate: sec. $C_{9-15}$ alkanesulfonate, Na salt
Nonionic surfactant 2: $C_{14/15}$ alcohol ethoxylate with 7 EO Formulation 13 corresponds to the composition of a commercial domestic cleaner. The performance of this cleaner can be greatly improved by addition of a small amount of high molecular weight polyacrylate, as was shown in formulation 14.

EXAMPLE 4

According to a BASF information brochure on polymers and dispersants, polyacrylates of the Sokalan® CP/PA type are also used in industrial cleaners. They boost the cleaning performance by virtue of their pronounced dispersing properties.

Formulations:

| Formulation No. | 15 | 16 | 17 | 18 | 19 | 20 | 21 |
|---|---|---|---|---|---|---|---|
| FAS | 4% | | | → | | | |
| FAEOS | 6% | | | → | | | |
| Na gluconate | 2% | | | → | | | |
| $NaHCO_3$ | 0.5% | | | → | | | |
| Polymer 1 | — | 0.05% | 0.1% | 0.15% | 0.2% | 0.3% | 0.5% |
| Dist. water | Remainder | | | → | | | |
| Rel. CP (1) % | 123 | 114 | 114 | 111 | 107 | 111 | 104 |
| Rel. CP (2) % | 56 | 52 | 56 | 52 | 52 | 56 | 60 |

Formulations:

| Formulation No. | 22 | 23 | 24 | 25 | 26 | 27 | 28 |
|---|---|---|---|---|---|---|---|
| FAS | 4% | | | → | | | |
| FAEOS | 6% | | | → | | | |
| Na gluconate | 2% | | | → | | | |
| $NaHCO_3$ | 0.5% | | | → | | | |
| Polymer 2 | — | 0.05% | 0.1% | 0.15% | 0.2% | 0.3% | 0.5% |
| Dist. water | Remainder | | | → | | | |
| Rel. CP (1) % | 123 | 120 | 114 | 114 | 111 | 114 | 104 |
| Rel. CP (2) % | 56 | 56 | 60 | 56 | 52 | 56 | 60 |

The percentages shown represent percentages by weight of the pure active substance.
The abbreviations used in the Tables have the following meanings:
FAS: $C_{12/14}$ fatty alcohol sulfate, Na salt -continued Formulations:

| Formulation No. | 22 | 23 | 24 | 25 | 26 | 27 | 28 |
|---|---|---|---|---|---|---|---|

FAEOS: $C_{12/14}$ fatty alcohol ether sulfate with approximately 2 EO, Na salt
Polymer 1: polymer of maleic acid and acrylic acid, average MW approximately 70,000 (Sokalan ® CP5)
Polymer 2: polymer based on acrylic acid, average MW approximately 100,000 (Schlichte ® S)
Rel. CP (1): Cleaning power for dilute application in %
Rel. CP (2): cleaning power for concentrated application in %

In formulations 16 to 28, the compounds according to the invention were replaced by the commercially available polyacrylates polymer 1 (Sokalan® CP5) and polymer 2 (Schlichte® S). The results show that these polyacrylates do not have a detergency-boosting effect when used in small quantities. Accordingly, the detergency-boosting effect of the compounds according to the invention may be regarded as surprising.

EXAMPLE 5

The effect of high molecular weight polyethylene oxide as a detergency booster in surfactant-containing formulations is described in DE-PSS 28 40 463 and 28 40 464.

Formulations 29 to 40 below show that the cleaning performance of a starting formulation containing polyethylene oxide can be further enhanced by addition of the compound according to the invention.

Formulations:

| Formulation No. | 29 | 30 | 31 | 32 | 33 | 34 |
|---|---|---|---|---|---|---|
| FAS | 4% | | | → | | |
| FAEOS | 6% | | | → | | |
| Na gluconate | 2% | | | → | | |
| $NaHCO_3$ | 0.5% | | | → | | |
| Polymer 3 | — | — | 0.05% | 0.05% | 0.1% | 0.1% |
| Comp. of Example B | — | 0.1% | — | 0.1% | — | 0.1% |
| Dist. water | Remainder | | | → | | |
| Rel. CP (dilute) % | 123 | 136 | 118 | 143 | 130 | 148 |
| Rel. CP (conc.) % | 56 | 144 | 132 | 164 | 156 | 160 |

The quantities shown represent percentages by weight of the pure active substance.
The abbreviations used in the Table have the following meanings:
FAS: $C_{12/14}$ fatty alcohol sulfate, Na salt
FAEOS: $C_{12/14}$ fatty alcohol ether sulfate with approximately 2 EO, Na salt
Polymer 3: Polyethylene oxide with an average molecular molecular weight of approximately 600,000
Rel. CP (dilute): cleaning power for dilute application
Rel. CP (conc.): cleaning power for concentrated application

EXAMPLE 6

Formulations containing the compounds according to the invention may also be used as spray cleaners.

| Formulation No. | 35 | 36 |
|---|---|---|
| FAS | 0.04% | → |
| FAEOS | 0.06% | → |
| Na gluconate | 0.02% | → |
| $NaHCO_3$ | 0.005% | → |
| Comp. of Example B | 0.001% | 0.005% |
| Ethanol | 10% | → |

-continued

| Formulation No. | 35 | 36 |
|---|---|---|
| Dist. water | Remainder | → |

The quantities shown represent percentages by weight of the pure active substance.
The abbreviations used in the Table have the following meanings:
FAS: $C_{12/14}$ fatty alcohol sulfate, Na salt
FAEOS: $C_{12/14}$ fatty alcohol ether sulfate with approximately 2 EO, Na salt

EXAMPLE 7

The compounds according to the invention may also be incorporated in concentrated cleaners (for example 1+3 dilution concentrates).

Formulation No. 37

24% Alkanesulfonate

16% Nonionic surfactant 2

1% Compound of Example B

10% Butyl glycol

Remainder distilled water.

The quantities represent percentages by weight of the pure active substance.
Alkanesulfonate: sec. alkanesulfonate, Na salt
Nonionic surfactant 2:$C_{14/15}$ alcohol ethoxylate with 7 EO

What is claimed is:

1. An aqueous composition for cleaning hard surfaces consisting of anionic or nonionic surfactants, water-soluble organic or inorganic builder components, water-soluble solvents or solubilizers, and from 0.001 to 2% by weight based on the weight of said composition, of a detergency booster consisting of a copolymer of (a) from 20 to 80% by weight of esters selected from the group consisting of acrylic acid and methacrylic acid containing 1 to 4 carbon atoms in the alcohol component, and (b) from 20 to 80% by weight of acrylic acid and methacrylic acid, said copolymer having an intrinsic viscosity of at least 200 $ml.g^{-1}$ as measured in tetrahydrofuran at 20° C.

2. An aqueous composition as in claim 1 wherein said detergency booster is present in an amount of from 0.005 to 1% by weight, based on the weight of said composition.

3. An aqueous composition as in claim 1 wherein said copolymer has an intrinsic viscosity of at least 400 $ml.g^{-1}$ as measured in tetrahydrofuran at 20° C.

4. An aqueous composition as in claim 1 wherein said copolymer consists of 55% by weight of ethyl acrylate, 35% by weight of methacrylic acid, and 10% by weight of acrylic acid, and has an intrinsic viscosity of at least 200 $ml.g^{-1}$ as measured in tetrahydrofuran at 20° C.

5. An aqueous composition as in claim 1 containing 0.05 to 40% by weight of said surfactants, up to 10% by weight of said builder components, and the balance, water based on the weight of said composition.

6. An aqueous composition as in claim 1 wherein said surfactants and said copolymer are present in a weight ratio of at least about 20:1, respectively.

7. The process of boosting the detergency of a hard surface cleaning composition consisting of anionic or nonionic surfactants, water-soluble organic or inorganic builder components, water-soluble solvents or solubilizers, comprising adding to said composition from 0.001 to 2% by weight, based on the weight of said composition, of a detergency booster consisting of a copolymer of (a) from 20 to 80% by weight of esters selected from the group consisting of acrylic acid and methacrylic acid containing 1 to 4 carbon atoms in the alcohol component, and (b) from 20 to 80% by weight of acrylic acid and methacrylic acid, said copolymer having an intrinsic viscosity of at least 200 $ml.g^{-1}$ as measured in tetrahydrofuran at 20° C.

8. A process as in claim 7 wherein said detergency booster is present in an amount of from 0.005 to 1% by weight, based on the weight of said composition.

9. A process in claim 7 wherein said copolymer has an intrinsic viscosity of at least 400 $ml.g^{-1}$ as measured in tetrahydrofuran at 20° C.

10. A process as in claim 7 wherein said copolymer consists of 55% by weight of ethyl acrylate, 35% by weight of methacrylic acid, and 10% by weight of acrylic acid, and has an intrinsic viscosity of at least 200 $ml.g^{-1}$ as measured in tetrahydrofuran at 20° C.

11. A process as in claim 7 wherein said composition contains 0.05 to 40% by weight of said surfactants, up to 10% by weight of said builder components, and the balance, water, based on the weight of said composition.

12. A process as in claim 11 wherein said surfactants and said copolymer are present in a weight ratio of at least about 20:1, respectively.

* * * * *